US011569014B2

(12) United States Patent
Moro et al.

(10) Patent No.: US 11,569,014 B2
(45) Date of Patent: Jan. 31, 2023

(54) DUST CORE AND INDUCTOR ELEMENT

(71) Applicant: TDK CORPORATION, Tokyo (JP)

(72) Inventors: Hideharu Moro, Tokyo (JP); Akihiro Harada, Tokyo (JP); Masahito Koeda, Tokyo (JP)

(73) Assignee: TDK CORPORATION, Tokyo (JP)

( * ) Notice: Subject to any disclaimer, the term of this patent is extended or adjusted under 35 U.S.C. 154(b) by 872 days.

(21) Appl. No.: 16/415,722

(22) Filed: May 17, 2019

(65) Prior Publication Data

US 2019/0355499 A1 Nov. 21, 2019

(30) Foreign Application Priority Data

May 18, 2018 (JP) ..... JP2018-095866

(51) Int. Cl.

| | |
|---|---|
| ***H01F 1/24*** | (2006.01) |
| ***H01F 27/255*** | (2006.01) |
| ***H01F 3/08*** | (2006.01) |
| ***B22F 1/052*** | (2022.01) |

(52) U.S. Cl.

CPC ..... *H01F 1/24* (2013.01); *B22F 1/052* (2022.01); *H01F 3/08* (2013.01); *H01F 27/255* (2013.01); *B22F 2301/15* (2013.01); *B22F 2301/20* (2013.01); *B22F 2301/35* (2013.01); *B22F 2304/10* (2013.01)

(58) Field of Classification Search

CPC ..... H01F 1/24; H01F 3/08

USPC ..... 336/233

See application file for complete search history.

(56) References Cited

U.S. PATENT DOCUMENTS

| | | | | |
|---|---|---|---|---|
| 2011/0272622 | A1 | 11/2011 | Wakabayashi et al. | |
| 2012/0001710 | A1 | 1/2012 | Wakabayashi et al. | |
| 2016/0314889 | A1* | 10/2016 | Ryu | H01F 41/0246 |

FOREIGN PATENT DOCUMENTS

| | | | |
|---|---|---|---|
| JP | 2016-208002 | A | 12/2016 |
| WO | 2010/082486 | A1 | 7/2010 |
| WO | 2010/103709 | A1 | 9/2010 |

* cited by examiner

*Primary Examiner* — Weiping Zhu

(74) *Attorney, Agent, or Firm* — Oliff PLC

(57) ABSTRACT

A dust core includes large particles having an average particle size of 8-15 μm, medium particles having an average particle size of 1-5 μm, and small particles having an average particle size of 300-900 nm when a cross section thereof is observed. An area ratio occupied by the large particles is 50% to 90%, an area ratio occupied by the medium particles is 0% to 30%, and an area ratio occupied by the small particles is 5% to 30%, when a total area ratio occupied by the large particles, the medium particles and the small particles is 100% in the cross section. Vickers hardness (Hv) of the large particles, the medium particles and the small particles is 150-600 respectively. The small particles are alloy powder containing Fe and at least Si or N. The dust core may be included in an inductor element.

13 Claims, 2 Drawing Sheets

DUST CORE AND INDUCTOR ELEMENT

BACKGROUND OF THE INVENTION

The present invention relates to a dust core and an inductor element including the same.

In recent years, increasing high frequency of a power supply is progressing, and an inductor element suitable for use in a high frequency band of several MHz is required. In addition, an inductor element excellent in DC superimposition characteristics for miniaturization and low in core loss for increasing the efficiency of the power supply is required. Further, a dust core having a high withstand voltage is required to ensure reliability in automotive applications, particularly in applications of ECU drive circuits.

WO 2010/082486 discloses a dust core made of metallic magnetic powder having predetermined Vickers hardness (Hv). However, WO 2010/082486 does not consider use of the dust core in a high frequency band such as several MHz, and does not disclose that three types of particles having different particle sizes are used as the metallic magnetic powder.

WO 2010/103709 also discloses a dust core made of metallic magnetic powder having predetermined Vickers hardness (Hv). However, the dust core disclosed in the embodiment of WO 2010/103709 has low DC superimposition characteristics (permeability) and is insufficient for miniaturization. In addition, the core loss in the high frequency band (1 MHz) is large, and the efficiency of the power supply is insufficient. Further, it is not disclosed that three types of particles having different particle sizes are used as the metallic magnetic powder.

[Patent Document 1] WO2010/082486

[Patent Document 2] WO2010/103709

BRIEF SUMMARY OF INVENTION

The present invention has been made in view of such circumstances, and an object thereof is to provide a dust core excellent in DC superimposition characteristics, low in core loss and excellent in withstand voltage at a high frequency band of several MHz, and an inductor element including the dust core.

The present inventors have found that a dust core excellent in DC superimposition characteristics, low in core loss and excellent in withstand voltage at a high frequency band of several MHz can be obtained by containing large particles, medium particles and small particles having predetermined range of Vickers hardness (Hv) at predetermined ratios.

The summary of the present invention is as follows.

(1) A dust core including large particles having an average particle size of 8 μm or more and 15 μm or less, medium particles having an average particle size of 1 μm or more and 5 μm or less, and small particles having an average particle size of 300 nm or more and 900 nm or less when a cross section thereof is observed, wherein an area ratio occupied by the large particles is 50% to 90%, an area ratio occupied by the medium particles is 0% to 30%, and an area ratio occupied by the small particles is 5% to 30%, when a total area ratio occupied by the large particles, the medium particles and the small particles is 100% in the cross section, wherein Vickers hardness (Hv) of the large particles, the medium particles and the small particles is 150 or more and 600 or less respectively, and wherein the small particles are alloy powder containing Fe and at least Si or Ni.

(2) The dust core according to (1), wherein the small particles have an electric resistivity of 40 μΩ·cm or more.

(3) The dust core according to (1) or (2), wherein the small particles contain one or more elements selected from the group consisting of Co and Cr.

(4) An inductor element containing the dust core according to any one of (1) to (3).

According to the present invention, a dust core excellent in DC superimposition characteristics, low in core loss and excellent in withstand voltage at a high frequency band of several MHz, and an inductor element including the dust core can be provided.

DETAILED DESCRIPTION OF INVENTION

Hereinafter, the present invention will be described based on specific embodiments, but various modifications are allowed without departing from the gist of the present invention.

(Inductor Element)

The dust core according to the present embodiment is suitably used as a magnetic core of an inductor element.

Further, the inductor element according to the present embodiment may be, for example, a coil-type electronic component in which an air-core coil wound with a wire is embedded in a dust core having a predetermined shape.

Figure 1:
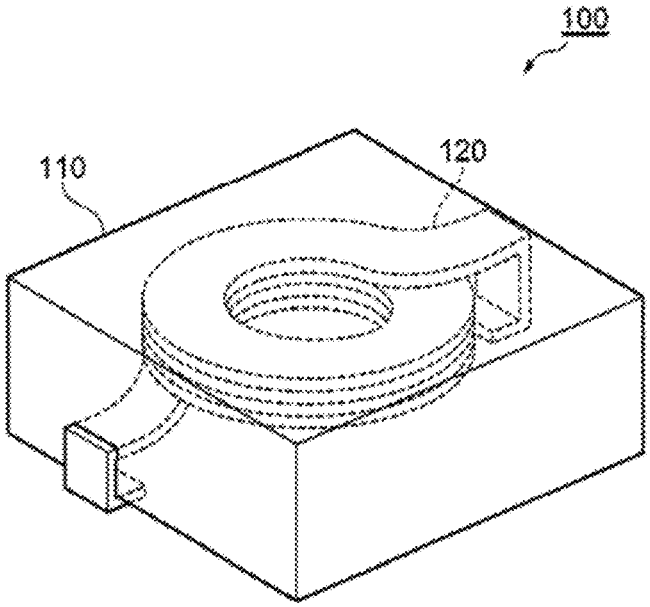
FIG. 1 is a schematic perspective view showing an inductor element according to an embodiment of the present invention.

FIG. 1 shows a preferred example of the coil-type electronic component in which the wire-wound air core coil is embedded in the dust core. In FIG. 1, an inductor element 100 includes a core 110 integrally formed in a hexahedral shape in which each face is continuous at right angles to each other, and a coil 120 embedded in the core 110 and exposed only at both ends.

In FIG. 1, the coil 120 is formed by spirally winding a flat rectangular wire having a rectangular cross section such that one short side of the rectangle faces the center. Both ends of the coil 120 are drawn from a wound portion. In addition, an outer periphery of the coil 120 is covered with an insulating layer. The both ends of the coil 120 project outward from height middle portions of two parallel side surfaces of the core 110. From the wound portion, the both ends are first bent along the side surface of the core 110 and further bent along a back surface of the core 110 at a tip. Since the both ends of the coil 120 function as terminals, both ends are not covered with the insulating layer.

The material of the coil 120 and the insulating layer covering the coil 120 is not particularly limited as long as it is a material for use in the coil and the insulating layer corresponding to the inductor element in the related art.

The core 110 of the inductor element 100 is made of the dust core according to the present embodiment.

In addition, the inductor element according to the present embodiment may be a coil-type electronic component in which a predetermined number of turns of wires are wound on a surface of a dust core having a predetermined shape. Examples of the shape of the magnetic core around which the wire is wound can include an FT shape, an ET shape, an EI shape, a UU shape, an EE shape, an EER shape, a UI shape, a drum shape, a toroidal shape, a pot shape, a cup shape or the like.

(Dust Core)

Figure 2:
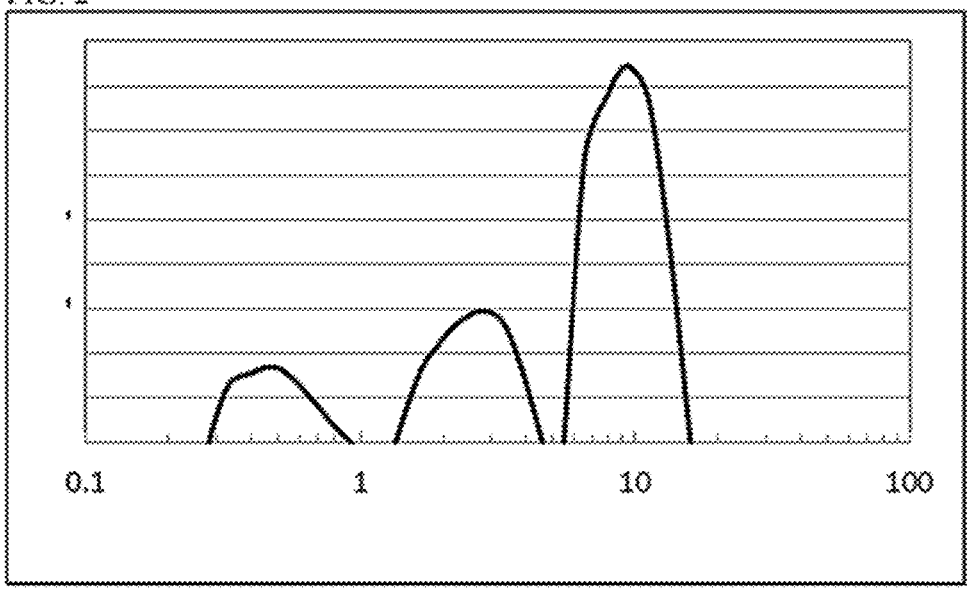
FIG. 2 is an example of a particle size distribution of particles observed in a cross section of a dust core according to the embodiment of the present invention.

In the dust core according to the present embodiment, large particles, medium particles and small particles are observed in a cross section (cut surface) thereof. The large particles, the medium particles and the small particles can be distinguished by the particle size distribution as shown in FIG. 2. The peak shown in the particle size distribution is the average particle size of the particle group. FIG. 2 is an example of a particle size distribution displaying large particles having an average particle size of 10 μm, medium particles having an average particle size of 3 μm, and small particles having an average particle size of 500 nm.

In the dust core according to the present embodiment, large particles are defined as particles having an average particle size of 8 μm or more and 15 μm or less in the particle size distribution of particles observed in the cross section. Medium particles are defined as particles having an average particle size of 1 μm or more and 5 μm or less in the particle size distribution of particles observed in the cross section. Small particles are defined as particles having an average particle size of 300 nm or more and 900 nm or less in the particle size distribution of particles observed in the cross section.

The large particles are preferably defined as a particle group having an average particle size of 8 μm or more and 13 μm or less, and more preferably a particle group having an average particle size of 8 μm or more and 10 μm or less.

In addition, the medium particles are preferably defined as a particle group having an average particle size of 2 μm or more and 5 μm or less, and more preferably a particle group having an average particle size of 3 μm or more and 5 μm or less.

Further, the small particles are preferably defined as a particle group having an average particle size of 300 nm or more and 700 nm or less, and more preferably a particle group having an average particle size of 450 nm or more and 700 nm or less.

In the dust core according to the present embodiment, when a total area ratio occupied by the large particles, the medium particles and the small particles defined above is 100% in the cross section, an area ratio occupied by the large particles is 50% to 90%, an area ratio occupied by the medium particles is 0% to 30%, and an area ratio occupied by the small particles is 5% to 30%.

The area ratio occupied by the large particles is preferably 60% to 90%, more preferably 65% to 90%, and still more preferably 70% to 80%.

The area ratio occupied by the medium particles is preferably more than 0% to 30%, more preferably 5% to 30%, and still more preferably 5% to 20%.

The area ratio occupied by the small particles is preferably 5% to 20%, more preferably 5% to 15%, and still more preferably 5% to 10%.

In the dust core according to the present embodiment, particles other than the above large particles, the medium particles and the small particles may be observed in the cross section. That is, a particle group having an average particle size of less than 300 nm, a particle group having an average particle size of more than 900 nm and less than 1 μm, a particle group having an average particle size of more than 5 μm and less than 8 μm, and a particle group having an average particle size of more than 15 μm may be present in the cross section.

Figure 3:
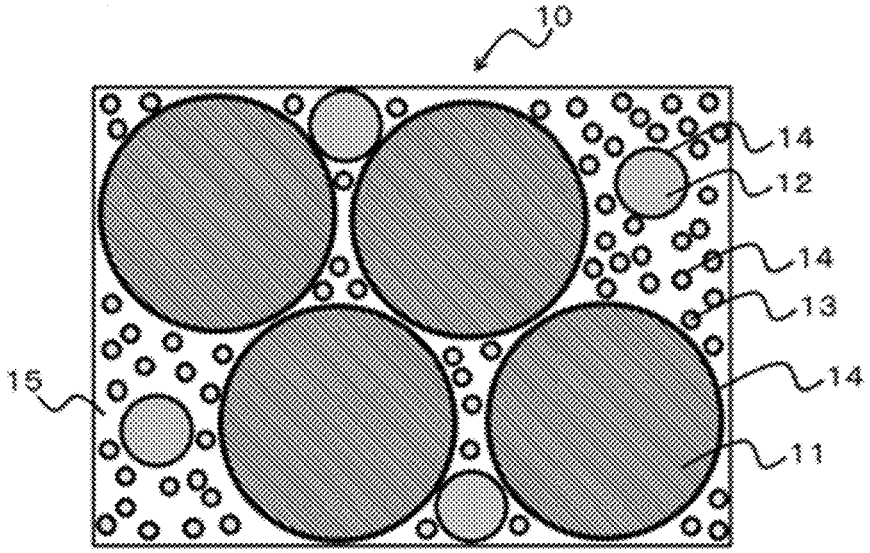
FIG. 3 is a schematic view showing a cross section of the dust core according to the embodiment of the present invention.

The cross section of the dust core can be observed with an SEM image. FIG. 3 shows a schematic view thereof. In the cross section, large particles 11, medium particles 12 and small particles 13 are observed, and an insulating coating 14 covering the above particles can also be observed. Spaces 15 may be voids, and may include a binding material to be described later. In the present embodiment, the circle equivalent diameters of the particles observed in the SEM image of the cross section are calculated, and are taken as the particle sizes. At this time, the particle size does not include a thickness of an insulating layer 14. The particle size distribution is obtained from the particle sizes.

In the present embodiment, the ratio of the area occupied by the large particles, the area occupied by the medium particles, and the area occupied by the small particles is substantially equal to the weight ratio of raw material large particles which are materials of the large particles, raw material medium particles which are materials of the medium particles, and raw material small particles which are materials of the small particles in the cross section of the dust core. Therefore, in the present embodiment, in a case where a total weight of the raw material large particles, the raw material medium particles and the raw material small particles contained in the dust core is 100%, the respective weight ratios of the raw material large particles, the raw material medium particles, and the raw material small particles can be taken as the respective area ratios of the large particles, the medium particles and the small particles in the cross section of the dust core. The total area occupied by the large particles, the medium particles and the small particles in the cross section of the dust core is 100%.

In the dust core according to the present embodiment, the Vickers hardness (Hv) of each of the large particles, the medium particles and the small particles is 150 or more and 600 or less, and preferably 300 or more and 600 or less.

As to be described later, the dust core is formed by compressing soft magnetic material powder containing raw material particles of large particles, medium particles and small particles in a mold. When the dust core is removed from the mold, the side surface of the dust core rubs strongly against the inner surface of the mold. When the Vickers hardness (Hv) is too low, soft magnetic material powder on the side surface of the dust core is stretched and deformed during demolding, and as a result, the withstand voltage may be lowered. In addition, when the Vickers hardness (Hv) is too large, the DC superimposition characteristics may be lowered. The Vickers hardness (Hv) may be the same or different for the large particles, the medium particles and the small particles as long as it is within the above range.

The Vickers hardness (Hv) is determined by a micro Vickers hardness test. A diamond square pyramid indenter is pushed into the large particles, medium particles or small particles at a facing angle of 136 degrees, and the size of the resulting indentation is measured and calculated. The indentation can be observed through a CCD camera. In the present embodiment, an average value of values obtained by measuring 5 times or more is used. The Vickers hardness (Hv) is a value obtained by dividing a load F [N] by a depression surface area S [$m^2$], and is obtained by the following equation based on a depression diagonal length d [m] measured.

$$\text{Vickers hardness}(Hv)=F/S=1.854\times F/d^2$$

In the present embodiment, the small particles preferably have an electric resistivity of 25 μΩ·cm or more, more preferably 40 μΩ·cm or more, and still more preferably 55 μΩ·cm or more. In addition, an upper limit of the electric resistivity of the small particles is not particularly limited.

In the present embodiment, the small particles are alloy powder containing Fe and at least Si or Ni, and preferably alloy powder containing at least Fe and Si. In addition, the small particles may further contain one or more elements selected from the group consisting of Co and Cr. Therefore, as the small particles, for example, an Fe—Si alloy, an Fe—Ni alloy, an Fe—Si—Cr alloy, and an Fe—Ni—Si—Co alloy can be used.

In addition, in the present embodiment, the medium particles are preferably alloy powder containing Fe, more preferably alloy powder containing Fe and at least Si or Ni, and still more preferably alloy powder containing at least Fe and Si. The medium particles may further contain one or more elements selected from the group consisting of Co and Cr. Therefore, as the medium particles, for example, an Fe—Si alloy, an Fe—Ni alloy, an Fe—Si—Cr alloy, and an Fe—Ni—Si—Co alloy can be used.

Further, in the present embodiment, the large particles are preferably alloy powder containing Fe, more preferably alloy powder containing Fe and at least Si or Ni, and still more preferably alloy powders containing at least Fe and Si. The large particles may further contain one or more elements selected from the group consisting of Co and Cr. Therefore, as the large particles, for example, an Fe—Si alloy, an Fe—Ni alloy, an Fe—Si—Cr alloy, and an Fe—Ni—Si—Co alloy can be used.

In the present embodiment, the large particles, the medium particles and the small particles may have the same composition or different compositions.

A method for manufacturing the raw material large particles, which are materials of the large particles, is not particularly limited. For example, the large particles are manufactured by various powdering methods such as atomization methods (for example, a water-atomization method, a gas-atomization method, and a high-speed rotating water flow atomization method), a reduction method, a carbonyl method, and a grinding method. The water-atomization method is preferred.

A method for manufacturing the raw material medium particles, which are materials of the medium particles, is not particularly limited. For example, the medium particles are manufactured by various powdering methods such as a water-atomization method and a grinding method. The water-atomization method is preferred.

A method for manufacturing the raw material small particles, which are materials of the small particles, is not particularly limited. For example, the small particles are manufactured by various powdering methods such as a grinding method, a liquid phase method, a spray pyrolysis method and a melt method.

In the present embodiment, an average particle size of the raw material large particles, which are materials of the large particles, is preferably 8 μm to 15 μm, more preferably 8 μm to 13 μm, and still more preferably 8 μm to 10 μm.

In addition, an average particle size of the raw material medium particles, which are materials of the medium particles, is preferably 1 μm to 5 μm, more preferably 2 μm to 5 μm, and still more preferably 3 μm to 5 μm.

Further, an average particle size of the raw material small particles, which are materials of the small particles, is preferably 300 nm to 900 nm, more preferably 300 nm to 700 nm, and still more preferably 450 nm to 700 nm.

In the present embodiment, the average particle size of the raw material large particles substantially coincides with the average particle size of the large particles in the cross section of the dust core. In addition, the average particle size of the raw material medium particles substantially coincides with the average particle size of the medium particles in the cross section of the dust core. Further, the average particle size of the raw material small particles substantially coincides with the average particle size of the small particles in the cross section of the dust core.

In the present embodiment, it is preferable that the raw material large particles, the raw material medium particles and the raw material small particles are insulated to each other. Examples of an insulation method include a method of forming an insulating layer on the particle surface. Examples of the insulating layer include a layer formed of a resin or an inorganic material, and an oxide layer formed by oxidizing the particle surface through heat treatment. In a case of forming the insulating layer using a resin or an inorganic material, examples of the resin include a silicone resin and an epoxy resin. Examples of the inorganic material include: phosphates such as magnesium phosphate, calcium phosphate, zinc phosphate, manganese phosphate, and cadmium phosphate; silicates such as sodium silicate (water glass); soda lime glass; borosilicate glass; lead glass; aluminosilicate glass; borate glass; and sulfate glass. When an insulating layer is formed on surfaces of the raw material large particles, the raw material medium particles and the raw material small particles, the insulating property of each particle can be enhanced.

The insulating layer on the raw material large particles preferably have a thickness of 10 nm to 400 nm, more preferably 20 nm to 200 nm, and still more preferably 30 nm to 150 nm. In addition, the insulating layer on the raw material medium particles preferably have a thickness of 5 nm to 70 nm, more preferably 10 nm to 50 nm, and still more preferably 10 nm to 30 nm. Further, the insulating layer on the raw material small particles preferably have a thickness of 3 nm to 30 nm, more preferably 5 nm to 20 nm, and still more preferably 5 nm to 10 nm. The thickness of the insulating layer on the raw material large particles, the raw material medium particles and the raw material small particles coincides with the thickness of the insulating layer observed in the cross section of the dust core. When the thickness of the insulating layer is within the above range, corrosion resistance can be obtained, and the reduction of the permeability μ and the withstand voltage can be prevented. The insulating layer may cover the entire surfaces of the raw material large particles, the raw material medium particles and the raw material small particles, or may cover only a part of the surfaces.

(Binding Material)

The dust core can contain a binding material. The binding material is not particularly limited, and examples thereof include various organic polymer resins, silicone resins, phenol resins, epoxy resins, and water glass. A content of the binding material is not particularly limited. For example, when the whole dust core is 100 wt %, the total content of the raw material large particles, the raw material medium particles and the raw material small particles can be 90 wt % to 98 wt %, and the content of the binding material can be 2 wt % to 10 wt %.

(Method for Manufacturing Dust Core)

A method for manufacturing the dust core is not particularly limited, and a known method can be adopted. Examples include the following method. First, the raw material large particles which are materials of the large particles, the raw material medium particles which are materials of the medium particles, and the raw material small particles which are materials of the small particles are mixed at a predetermined ratio, so as to obtain soft magnetic material powder. The insulated soft magnetic material powder and the binding material are mixed to obtain mixed powder. If necessary, the obtained mixed powder may be used as granulated powder. Then, the mixed powder or granulated powder is filled in a mold and compression-molded to obtain a molded body having a shape of a magnetic body (dust core) to be prepared. The obtained molded body is subject to heat treatment if necessary, so as to obtain a dust core having a predetermined shape to which the soft magnetic powder is fixed. A condition of the heat treatment is not particularly limited. For example, the heat treatment temperature can be 150° C. to 220° C. and the heat treatment time can be 1 hour to 10 hours. In addition, an atmosphere during the heat treatment is also not particularly limited. For example, the heat treatment can be performed in an air atmosphere or an inert gas atmosphere such as argon or nitrogen. A wire is wound a predetermined number of times on the obtained dust core, so as to obtain an inductor element.

The mixed powder or granulated powder and an air-core coil formed by winding the wire a predetermined number of times may be filled in a mold and compression-molded to obtain a molded body embedded with the coil. The obtained molded body is subject to heat treatment if necessary, so as to obtain a dust core having a predetermined shape embedded with the coil. Since such a dust core has a coil embedded therein, the dust core functions as an inductor element.

(Magnetic Property)

<Permeability>

The inductance of the dust core at a frequency of 3 MHz is measured, and the permeability of the dust core is calculated based on the inductance. In the dust core according to the present embodiment, the permeability when the DC superimposed magnetic field is 0 A/m and 8000 A/m is referred to as initial permeability μi (0 A/m) and DC permeability μdc (8000 A/m), respectively.

The initial permeability μi of the dust core according to the present embodiment is preferably 33 or more, more preferably 38 or more, and still more preferably 43 or more.

In addition, the DC permeability μdc of the dust core according to the present embodiment is preferably 22 or more, more preferably 28 or more, and still more preferably 33 or more.

<Core Loss>

Core loss is measured under the conditions of frequencies 3 MHz and 5 MHz and a measured magnetic flux density of 10 mT.

The core loss of the dust core according to the present embodiment when the frequency is 3 MHz is preferably 505 $kW/m^3$ or less, more preferably 458 $kW/m^3$ or less, and still more preferably 335 $kW/m^3$ or less.

The core loss of the dust core according to the present embodiment when the frequency is 5 MHz is preferably 1170 $kW/m^3$ or less, more preferably 970 $kW/m^3$ or less, and still more preferably 770 $kW/m^3$ or less.

<Withstand Voltage>

A dust core formed into a cylindrical shape having a diameter of 12.7 mm and a height of 5 mm is sandwiched between a pair of copper plates, a voltage is applied to the copper plate, and a voltage when a current of 0.5 mA flows is defined as a withstand voltage.

The withstand voltage of the dust core according to the present embodiment is preferably 200 V/5 mm or more, more preferably 450 V/5 mm or more, still more preferably 800 V/5 mm or more, and particularly preferably 1000 V/5 mm or more.

Although the embodiment of the present invention has been described above, the present invention is not limited to the above embodiment at all and modifications may be made in various modes within the scope of the present invention.

EXAMPLES

Hereinafter, the present invention will be described in more detail by way of examples, but the present invention is not limited to these examples.

The average particle size, the area ratio, the Vickers hardness (Hv), the electric resistivity of small particles, the initial permeability (μi), the DC permeability (μdc), and the core loss were measured as follows. The results are shown in Tables 1 and 2.

<Average Particle Size and Area Ratio>

The dust core was fixed with a cold-mounting resin, and the cross section was cut out, mirror-polished, and observed with SEM. The particle size distribution of the soft magnetic material powder in the SEM image was measured by using image analysis software (Mac-View manufactured by Mountech Co., Ltd.), so as to obtain the average particle size (D50) of the large particles, the medium particles and the small particles. A particle group having an average particle size in the range of 8 μm to 15 μm was taken as large particles, a particle group having an average particle size in the range of 1 μm to 5 μm was taken as medium particles, and a particle group having an average particle size in the range of 300 nm to 900 nm was taken as small particles. When the total area ratio occupied by the large particles, the medium particles and the small particles in the cross section of the dust core was taken as 100%, the area ratios occupied by the large particles, the medium particles and the small particles were determined separately.

<Vickers Hardness (Hv)>

The Vickers hardness (Hv) was measured by using a microhardness tester (MVK-03 manufactured by Akashi Seisakusho, Ltd.).

<Electric Resistivity of Small Particles>

The electric resistivity of sample particles prepared to have the same composition as that of the small particles was measured and used as the electric resistivity of the small particles. That is, the sample particles having the same composition as the small particles and having a diameter of approximately 10 μm were fixed with a resin, the cross section was cut out, four measurement terminals made of tungsten were placed on the sample particles, a voltage was applied thereto, and a current at that time was measured to determine the electric resistivity. Since the electric resistivity largely depends on the composition, the electric resistivity of the sample particles is considered to be the same as the electric resistivity of the smaller particles having smaller particle sizes.

<Initial Permeability (μi) and DC Permeability (μdc)>

Inductance of the dust core at a frequency of 3 MHz was measured by using an LCR meter (4284A, manufactured by Agilent Technologies) and a DC bias power supply (42841A, manufactured by Agilent Technologies), and the permeability of the dust core was calculated based on the inductance. The inductance was measured in a case where a DC superimposed magnetic field was 0 A/m and a case where the DC superimposed magnetic field was 8,000 A/m, and the permeabilities of the cases were taken as μi (0 A/m) and μdc (8000 A/m), respectively.

<Core Loss>

The core loss was measured by using a BH analyzer (SY-8258 manufactured by IWATSU ELECTRIC CO., LTD.) under conditions of frequencies of 3 MHz and 5 MHz and a measurement magnetic flux density of 10 mT.

<Withstand Voltage>

A dust core formed into a cylindrical shape having a diameter of 12.7 mm and a height of 5 mm was sandwiched between a pair of copper plates, a voltage was applied to the copper plate, and a voltage when a current of 0.5 mA flows was measured.

Example 1

Raw material large particles having a composition of $Fe_{1.5}Si$ and an average particle size of 10 μm were obtained by a water-atomization method. In addition, raw material medium particles having a composition of $Fe_{6.5}Si$ and an average particle size of 3 μm were obtained by a water-atomization method. Further, raw material small particles having a composition of $Fe_{6.5}Si$ and an average particle size of 700 nm were obtained by a liquid phase method.

When the total weight of the raw material large particles, the raw material medium particles and the raw material small particles was taken as 100 wt %, the raw material large particles, the raw material medium particles and the raw material small particles were blended at a ratio of 80 wt %, 10 wt % and 10 wt %, to obtain soft magnetic material powder.

An insulating layer having a thickness of 10 nm was formed using zinc phosphate on the soft magnetic material powder.

A silicone resin diluted with xylene was added so as to be 3 wt % with respect to 100 wt % of the soft magnetic material powder formed with the insulating layer in total, then the mixture was kneaded with a kneader, and dried, and the obtained agglomerates were sized to have a size of 355 μm or less to obtain granules. The granules were filled in a toroidal mold having an outer diameter of 17.5 mm and an inner diameter of 11.0 mm and pressed at a molding pressure of 6 t/cm$^2$ to obtain a molded body. The core weight was 5 g. The obtained molded body was subject to heat treatment in a belt furnace at 750° C. for 30 minutes at a nitrogen atmosphere to obtain a dust core.

The dust core was fixed with a cold-mounting resin, and the cross section was cut out, mirror-polished, and observed with SEM. The particle size distribution of the soft magnetic material powder in the SEM image was measured to obtain an average particle size. A particle group having an average particle size of 8 μm or more and 15 μm or less was taken as large particles, a particle group having an average particle size of 1 μm or more and 5 μm or less was taken as medium particles, and a particle group having an average particle size of 300 nm or more and 900 nm or less was taken as small particles. The total area ratio occupied by the large particles, the medium particles and the small particles in the cross section was taken as 100%. The area ratio occupied by the large particles was 80%, the area ratio occupied by the medium particles was 10%, and area ratio occupied by the small particles was 10%, which coincided with the weight ratios of the raw material large particles, the raw material medium particles and the raw material small particles contained in the dust core.

In the following Examples, the area ratios occupied by the large particles, the medium particles and the small particles in the cross section of the obtained dust core also coincided with the weight ratios of the raw material large particles, the raw material medium particles and the raw material small particles contained in the dust core. The total area ratio occupied by the large particles, the medium particles and the small particles was taken as 100%.

In addition, in all examples, the average particle size of the raw material large particles substantially coincided with the average particle size of the large particles in the cross section of the dust core. The average particle size of the raw material medium particles substantially coincided with the average particle size of the medium particles in the cross section of the dust core. Further, the average particle size of the raw material small particles substantially coincided with the average particle size of the small particles in the cross section of the dust core.

Example 2

A dust core was obtained in the same manner as in Example 1 except that raw material large particles having a composition of $Fe_{4.5}Si$ were used.

Example 3

A dust core was obtained in the same manner as in Example 1 except that raw material large particles having a composition of $Fe_{6.5}Si$ were used.

Example 4

A dust core was obtained in the same manner as in Example 1 except that raw material large particles having a composition of $Fe_{7.5}Si$ were used.

Comparative Example 1

A dust core was obtained in the same manner as in Example 1 except that raw material large particles having a composition of $Fe_{0.5}Si$ were used.

Comparative Example 2

A dust core was obtained in the same manner as in Example 1 except that raw material large particles having a composition of $Fe_{9.5}Si_{5.5}Al$ were used.

Example 5

A dust core was obtained in the same manner as in Example 3 except that raw material medium particles having a composition of $Fe_{1.5}Si$ were used.

Example 6

A dust core was obtained in the same manner as in Example 3 except that raw material medium particles having a composition of $Fe_{4.5}Si$ were used.

Example 7

A dust core was obtained in the same manner as in Example 3 except that raw material medium particles having a composition of $Fe_{7.5}Si$ were used.

Comparative Example 3

A dust core was obtained in the same manner as in Example 1 except that raw material medium particles having a composition of $Fe_{0.5}Si$ were used.

Comparative Example 4

A dust core was obtained in the same manner as in Example 1 except that raw material medium particles having a composition of $F_{9.5}Si_{5.5}Al$ were used.

Example 8

A dust core was obtained in the same manner as in Example 3 except that raw material small particles having a composition of $Fe_{1.5}Si$ were used.

Example 9

A dust core was obtained in the same manner as in Example 3 except that raw material small particles having a composition of $Fe_{4.5}Si$ were used.

Example 10

A dust core was obtained in the same manner as in Example 3 except that raw material small particles having a composition of $Fe_{7.5}Si$ were used.

Comparative Example 5

A dust core was obtained in the same manner as in Example 1 except that raw material small particles having a composition of $Fe_{0.5}Si$ were used.

Comparative Example 6

A dust core was obtained in the same manner as in Example 1 except that raw material small particles having a composition of $Fe_{8.2}Si$ were used.

Example 11

A dust core was obtained in the same manner as in Example 3 except that raw material large particles, raw material medium particles and raw material small particles each having a composition of $Fe_{48}Ni$ were used.

Example 12

A dust core was obtained in the same manner as in Example 3 except that raw material large particles having an average particle size of 8 μm were used.

Example 13

A dust core was obtained in the same manner as in Example 3 except that raw material large particles having an average particle size of 13 μm were used.

Example 14

A dust core was obtained in the same manner as in Example 3 except that raw material large particles having an average particle size of 15 μm were used.

Comparative Example 7

A dust core was obtained in the same manner as in Example 3 except that raw material large particles having an average particle size of 6 μm were used. Based on the particle size distribution from the SEM image of the cross section of the dust core, the presence of particles having an average particle size of 8 μm or more and 15 μm or less cannot be confirmed.

Comparative Example 8

A dust core was obtained in the same manner as in Example 3 except that raw material large particles having an average particle size of 20 μm were used. Based on the particle size distribution from the SEM image of the cross section of the dust core, the presence of particles having an average particle size of 8 μm or more and 15 μm or less cannot be confirmed.

Example 15

A dust core was obtained in the same manner as in Example 3 except that raw material medium particles having an average particle size of 1 μm were used.

Example 16

A dust core was obtained in the same manner as in Example 3 except that raw material medium particles having an average particle size of 5 μm were used.

Comparative Example 9

A dust core was obtained in the same manner as in Example 3 except that raw material medium particles having an average particle size of 0.7 μm were used. Based on the particle size distribution from the SEM image of the cross section of the dust core, the presence of particles having an average particle size of 1 μm or more and 5 μm or less cannot be confirmed.

Comparative Example 10

A dust core was obtained in the same manner as in Example 3 except that raw material medium particles having an average particle size of 6 μm were used. Based on the particle size distribution from the SEM image of the cross section of the dust core, the presence of particles having an average particle size of 1 μm or more and 5 μm or less cannot be confirmed.

Example 17

A dust core was obtained in the same manner as in Example 3 except that raw material small particles having an average particle size of 300 nm were used.

Example 18

A dust core was obtained in the same manner as in Example 3 except that raw material small particles having an average particle size of 500 nm were used.

Example 19

A dust core was obtained in the same manner as in Example 3 except that raw material small particles having an average particle size of 900 nm were used.

Comparative Example 11

A dust core was obtained in the same manner as in Example 3 except that raw material small particles having an average particle size of 200 nm were used. Based on the particle size distribution from the SEM image of the cross section of the dust core, the presence of particles having an average particle size of 300 nm or more and 900 nm or less cannot be confirmed.

Comparative Example 12

A dust core was obtained in the same manner as in Example 3 except that raw material small particles having an average particle size of 1000 nm were used. Based on the particle size distribution from the SEM image of the cross section of the dust core, the presence of particles having an average particle size of 300 nm or more and 900 nm or less cannot be confirmed.

Example 20

A dust core was obtained in the same manner as in Example 3 except that the raw material large particles, the raw material medium particles and the raw material small particles were blended at a ratio of 90 wt %, 5 wt % and 5 wt % when the total weight of the raw material large particles, the raw material medium particles and the raw material small particles was taken as 100 wt %.

Example 21

A dust core was obtained in the same manner as in Example 3 except that the raw material large particles, the raw material medium particles and the raw material small particles were blended at a ratio of 70 wt %, 20 wt % and 10 wt % when the total weight of the raw material large particles, the raw material medium particles and the raw material small particles was taken as 100 wt %.

Example 22

A dust core was obtained in the same manner as in Example 3 except that the raw material large particles, the raw material medium particles and the raw material small particles were blended at a ratio of 70 wt %, 10 wt % and 20 wt % when the total weight of the raw material large particles, the raw material medium particles and the raw material small particles was taken as 100 wt %.

Example 23

A dust core was obtained in the same manner as in Example 3 except that the raw material large particles, the raw material medium particles and the raw material small particles were blended at a ratio of 65 wt %, 30 wt % and 5 wt % when the total weight of the raw material large particles, the raw material medium particles and the raw material small particles was taken as 100 wt %.

Example 24

A dust core was obtained in the same manner as in Example 3 except that the raw material large particles, the raw material medium particles and the raw material small particles were blended at a ratio of 65 wt %, 5 wt % and 30 wt % when the total weight of the raw material large particles, the raw material medium particles and the raw material small particles was taken as 100 wt %.

Example 25

A dust core was obtained in the same manner as in Example 3 except that the raw material large particles, the raw material medium particles and the raw material small particles were blended at a ratio of 60 wt %, 20 wt % and 20 wt % when the total weight of the raw material large particles, the raw material medium particles and the raw material small particles was taken as 100 wt %.

Example 26

A dust core was obtained in the same manner as in Example 3 except that the raw material large particles, the raw material medium particles and the raw material small particles were blended at a ratio of 50 wt %, 30 wt % and 20 wt % when the total weight of the raw material large particles, the raw material medium particles and the raw material small particles was taken as 100 wt %.

Example 27

A dust core was obtained in the same manner as in Example 3 except that the raw material large particles, the raw material medium particles and the raw material small particles were blended at a ratio of 50 wt %, 20 wt % and 30 wt % when the total weight of the raw material large particles, the raw material medium particles and the raw material small particles was taken as 100 wt %.

Comparative Example 13

A dust core was obtained in the same manner as in Example 3 except that only raw material large particles were used without using raw material medium particles and raw material small particles. Based on the particle size distribution from the SEM image of the cross section of the dust core, the presence of particles having an average particle size of 1 μm or more and 5 μm or less and particles having an average particle size of 300 nm or more and 900 nm or less cannot be confirmed.

Comparative Example 14

A dust core was obtained in the same manner as in Example 3 except that the raw material small particles were not used, and the raw material large particles and the raw material medium particles were blended at a ratio of 80 wt % and 20 wt % when the total weight of the raw material large particles and the raw material medium particles was taken as 100 wt %. Based on the particle size distribution from the SEM image of the cross section of the dust core, the presence of particles having an average particle size of 300 nm or more and 900 nm or less cannot be confirmed.

Comparative Example 15

A dust core was obtained in the same manner as in Example 3 except that the raw material large particles, the raw material medium particles and the raw material small particles were blended at a ratio of 50 wt %, 45 wt % and 5 wt % when the total weight of the raw material large particles, the raw material medium particles and the raw material small particles was taken as 100 wt %.

Comparative Example 16

A dust core was obtained in the same manner as in Example 3 except that the raw material large particles, the raw material medium particles and the raw material small particles were blended at a ratio of 50 wt %, 5 wt % and 45 wt % when the total weight of the raw material large particles, the raw material medium particles and the raw material small particles was taken as 100 wt %.

Comparative Example 17

A dust core was obtained in the same manner as in Example 3 except that the raw material large particles, the raw material medium particles and the raw material small particles were blended at a ratio of 40 wt %, 30 wt % and 30 wt % when the total weight of the raw material large particles, the raw material medium particles and the raw material small particles was taken as 100 wt %.

Example 28

A dust core was obtained in the same manner as in Example 3 except that raw material small particles having a composition of $Fe_4Si_2Cr$ were used.

Example 29

A dust core was obtained in the same manner as in Example 3 except that raw material small particles having a composition of $FeNi_2Si_3Co$ were used.

TABLE 1

| | Composition | | | Average particle size of raw material particles | | | Blending Large particle · Medium particle · Small particle (wt %) | | | Vickers hardness (Hv) |
|---|---|---|---|---|---|---|---|---|---|---|
| | Large particles | Medium particles | Small particles | Large particles (μm) | Medium particles (μm) | Small particles (μm) | Large particles | Medium particles | Small particles | of large particles |
| Comparative Example 1 | Fe0.5Si | Fe6.5Si | Fe6.5Si | 10 | 3 | 700 | 80 | 10 | 10 | 130 |
| Example 1 | Fe1.5Si | Fe6.5Si | Fe6.5Si | 10 | 3 | 700 | 80 | 10 | 10 | 150 |
| Example 2 | Fe4.5Si | Fe6.5Si | Fe6.5Si | 10 | 3 | 700 | 80 | 10 | 10 | 300 |
| Example 3 | Fe6.5Si | Fe6.5Si | Fe6.5Si | 10 | 3 | 700 | 80 | 10 | 10 | 500 |
| Example 4 | Fe7.5Si | Fe6.5Si | Fe6.5Si | 10 | 3 | 700 | 80 | 10 | 10 | 600 |
| Comparative Example 2 | Fe9.5Si5.5A1 | Fe6.5Si | Fe6.5Si | 10 | 3 | 700 | 80 | 10 | 10 | 650 |
| Comparative Example 3 | Fe6.5Si | Fe0.5Si | Fe6.5Si | 10 | 3 | 700 | 80 | 10 | 10 | 500 |
| Example 5 | Fe6.5Si | Fe1.5Si | Fe6.5Si | 10 | 3 | 700 | 80 | 10 | 10 | 500 |
| Example 6 | Fe6.5Si | Fe4.5Si | Fe6.5Si | 10 | 3 | 700 | 80 | 10 | 10 | 500 |
| Example 3 | Fe6.5Si | Fe6.5Si | Fe6.5Si | 10 | 3 | 700 | 80 | 10 | 10 | 500 |
| Example 7 | Fe6.5Si | Fe7.5Si | Fe6.5Si | 10 | 3 | 700 | 80 | 10 | 10 | 500 |
| Comparative Example 4 | Fe6.5Si | Fe6.5Si | Fe6.5Si | 10 | 3 | 700 | 80 | 10 | 10 | 500 |
| Comparative Example 5 | Fe6.5Si | Fe9.5Si5.5A1 Fe6.5Si | Fe0.5Si | 10 | 3 | 700 | 80 | 10 | 10 | 500 |
| Example 8 | Fe6.5Si | Fe6.5Si | Fe1.5Si | 10 | 3 | 700 | 80 | 10 | 10 | 500 |
| Example 9 | Fe6.5Si | Fe6.5Si | Fe4.5Si | 10 | 3 | 700 | 80 | 10 | 10 | 500 |
| Example 3 | Fe6.5Si | Fe6.5Si | Fe6.5Si | 10 | 3 | 700 | 80 | 10 | 10 | 500 |
| Example 10 | Fe6.5Si | Fe6.5Si | Fe7.5Si | 10 | 3 | 700 | 80 | 10 | 10 | 180 |
| Comparative Example 6 | Fe6.5Si | Fe6.5Si | Fe8.2Si | 10 | 3 | 700 | 80 | 10 | 10 | 500 |
| Example 11 | Fe48Ni | Fe48Ni | Fe48Ni | 10 | 3 | 700 | 80 | 10 | 10 | 500 |
| Comparative Example 7 | Fe6.5Si | Fe6.5Si | Fe6.5Si | 6 | 3 | 700 | 80 | 10 | 10 | 500 |
| Example 12 | Fe6.5Si | Fe6.5Si | Fe6.5Si | 8 | 3 | 700 | 80 | 10 | 10 | 500 |
| Example 3 | Fe6.5Si | Fe6.5Si | Fe6.5Si | 10 | 3 | 700 | 80 | 10 | 10 | 500 |
| Example 13 | Fe6.5Si | Fe6.5Si | Fe6.5Si | 13 | 3 | 700 | 80 | 10 | 10 | 500 |
| Example 14 | Fe6.5Si | Fe6.5Si | Fe6.5Si | 15 | 3 | 700 | 80 | 10 | 10 | 500 |
| Comparative Example 8 | Fe6.5Si | Fe6.5Si | Fe6.5Si | 20 | 3 | 700 | 80 | 10 | 10 | 500 |

| | Vickers hardness (Hv) of medium particles | Vickers hardness (Hv) of small particles | Electric resistivity of small particles (μΩ · cm) | μi (at 3 MHz) | μ d c * (at 8000 A/m)) | Core loss (kW/m³ at 3 MHz, 10 mT) | Core loss (kW/m³ at 5 MHz, 10 mT) | Withstand voltage (V/5 mm) |
|---|---|---|---|---|---|---|---|---|
| Comparative Example 1 | 500 | 500 | 75 | 65 | 50 | 830 | 2210 | 110 |
| Example 1 | 500 | 500 | 75 | 64 | 44 | 482 | 960 | 465 |
| Example 2 | 500 | 500 | 75 | 55 | 39 | 368 | 830 | 667 |
| Example 3 | 500 | 500 | 75 | 43 | 33 | 315 | 724 | 937 |
| Example 4 | 500 | 500 | 75 | 37 | 31 | 332 | 764 | 1072 |
| Comparative Example 2 | 500 | 500 | 75 | 32 | 18 | 280 | 610 | 1140 |
| Comparative Example 3 | 130 | 500 | 75 | 58 | 46 | 423 | 960 | 155 |
| Example 5 | 150 | 500 | 75 | 57 | 41 | 380 | 854 | 535 |
| Example 6 | 300 | 500 | 75 | 51 | 37 | 342 | 760 | 707 |
| Example 3 | 500 | 500 | 75 | 43 | 33 | 315 | 724 | 937 |
| Example 7 | 600 | 500 | 75 | 39 | 30 | 328 | 754 | 1052 |

TABLE 1-continued

| | | | | | | | |
|---|---|---|---|---|---|---|---|
| Comparative Example 4 | 650 | 500 | 75 | 37 | 19 | 307 | 698 | 1110 |
| Comparative Example 5 | 500 | 130 | 15 | 52 | 42 | 410 | 970 | 175 |
| Example 8 | 500 | 150 | 25 | 51 | 40 | 376 | 915 | 605 |
| Example 9 | 500 | 300 | 55 | 48 | 36 | 345 | 852 | 747 |
| Example 3 | 500 | 500 | 75 | 43 | 33 | 315 | 724 | 937 |
| Example 10 | 500 | 600 | 80 | 40 | 30 | 325 | 768 | 1032 |
| Comparative Example 6 | 500 | 650 | 85 | 26 | 16 | 382 | 905 | 1050 |
| Example 11 | 180 | 180 | 40 | 66 | 40 | 335 | 810 | 412 |
| Comparative Example 7 | 500 | 500 | 75 | 32 | 20 | 201 | 584 | 1065 |
| Example 12 | 300 | 500 | 75 | 40 | 30 | 239 | 620 | 1022 |
| Example 3 | 500 | 500 | 75 | 43 | 33 | 315 | 724 | 937 |
| Example 13 | 500 | 500 | 75 | 46 | 37 | 429 | 960 | 809 |
| Example 14 | 500 | 500 | 75 | 49 | 39 | 505 | 1170 | 724 |
| Comparative Example 8 | 500 | 500 | 75 | 55 | 35 | 695 | 1880 | 511 |

TABLE 2

| | Composition | | | Average particle size of raw material particles | | | Blending Large particle · Medium particle · Small particle (wt %) | | | Vickers hardness (Hv) |
|---|---|---|---|---|---|---|---|---|---|---|
| | Large particles | Medium particles | Small particles | Large particles (μm) | Medium particles (μm) | Small particles (nm) | Large particles | Medium particles | Small particles | of large particles |
| Comparative Example 9 | Fe6.5Si | Fe6.5Si | Fe6.5Si | 10 | 0.7 | 700 | 80 | 10 | 10 | 500 |
| Example 15 | Fe6.5Si | Fe6.5Si | Fe6.5Si | 10 | 1 | 700 | 80 | 10 | 10 | 500 |
| Example 3 | Fe6.5Si | Fe6.5Si | Fe6.5Si | 10 | 3 | 700 | 80 | 10 | 10 | 500 |
| Example 16 | Fe6.5Si | Fe6.5Si | Fe6.5Si | 10 | 5 | 700 | 80 | 10 | 10 | 500 |
| Comparative Example 10 | Fe6.5Si | Fe6.5Si | Fe6.5Si | 10 | 6 | 700 | 80 | 10 | 10 | 500 |
| Comparative Example 11 | Fe6.5Si | Fe6.5Si | Fe6.5Si | 10 | 3 | 200 | 80 | 10 | 10 | 500 |
| Example 17 | Fe6.5Si | Fe6.5Si | Fe6.5Si | 10 | 3 | 300 | 80 | 10 | 10 | 500 |
| Example 18 | Fe6.5Si | Fe6.5Si | Fe6.5Si | 10 | 3 | 500 | 80 | 10 | 10 | 500 |
| Example 3 | Fe6.5Si | Fe6.5Si | Fe6.5Si | 10 | 3 | 700 | 80 | 10 | 10 | 500 |
| Example 19 | Fe6.5Si | Fe6.5Si | Fe6.5Si | 10 | 3 | 900 | 80 | 10 | 10 | 500 |
| Comparative Example 12 | Fe6.5Si | Fe6.5Si | Fe6.5Si | 10 | 3 | 1000 | 80 | 10 | 10 | 500 |
| Example 20 | Fe6.5Si | Fe6.5Si | Fe6.5Si | 10 | 3 | 700 | 90 | 5 | 5 | 500 |
| Example 3 | Fe6.5Si | Fe6.5Si | Fe6.5Si | 10 | 3 | 700 | 80 | 10 | 10 | 500 |
| Example 21 | Fe6.5Si | Fe6.5Si | Fe6.5Si | 10 | 3 | 700 | 70 | 20 | 10 | 500 |
| Example 22 | Fe6.5Si | Fe6.5Si | Fe6.5Si | 10 | 3 | 700 | 70 | 10 | 20 | 500 |
| Example 23 | Fe6.5Si | Fe6.5Si | Fe6.5Si | 10 | 3 | 700 | 65 | 30 | 5 | 500 |
| Example 24 | Fe6.5Si | Fe6.5Si | Fe6.5Si | 10 | 3 | 700 | 65 | 5 | 30 | 500 |
| Example 25 | Fe6.5Si | Fe6.5Si | Fe6.5Si | 10 | 3 | 700 | 60 | 20 | 20 | 500 |
| Example 26 | Fe6.5Si | Fe6.5Si | Fe6.5Si | 10 | 3 | 700 | 5 | 30 | 20 | 500 |
| Example 27 | Fe6.5Si | Fe6.5Si | Fe6.5Si | 10 | 3 | 700 | 50 | 20 | 30 | 500 |
| Comparative Example 13 | Fe6.5Si | — | — | 10 | — | — | 100 | — | — | 500 |
| Comparative Example 14 | Fe6.5Si | Fe6.5Si | — | 10 | 3 | — | 80 | 20 | — | 500 |
| Comparative Example 15 | Fe6.5Si | Fe6.5Si | Fe6.5Si | 10 | 3 | 700 | 50 | 45 | 5 | 500 |
| Comparative Example 16 | Fe6.5Si | Fe6.5Si | Fe6.5Si | 10 | 3 | 700 | 50 | 5 | 45 | 500 |
| Comparative Example 17 | Fe6.5Si | Fe6.5Si | Fe6.5Si | 10 | 3 | 700 | 40 | 30 | 30 | 500 |
| Example 28 | Fe6.5Si | Fe6.5Si | Fe4Si2Cr | 10 | 3 | 700 | 80 | 10 | 10 | 500 |
| Example 29 | Fe6.5Si | Fe6.5Si | FeNi2Si3Co | 10 | 3 | 700 | 80 | 10 | 10 | 500 |

TABLE 2-continued

| | Vickers hardness (Hv) of medium particles | Vickers hardness (Hv) of small particles | Electric resistivity of small particles (μΩ · cm) | μi (at 3 MHz) | μ d c * (at 8000 A/m)) | Core loss (kW/m³ at 3 MHz, 10 mT) | Core loss (kW/m³ at 5 MHz, 10 mT) | Withstand voltage (V/5 mm) |
|---|---|---|---|---|---|---|---|---|
| Comparative Example 9 | 500 | 500 | 75 | 32 | 19 | 209 | 654 | 985 |
| Example 15 | 500 | 500 | 75 | 42 | 31 | 297 | 692 | 979 |
| Example 3 | 500 | 500 | 75 | 43 | 33 | 315 | 724 | 937 |
| Example 16 | 500 | 500 | 75 | 44 | 34 | 458 | 970 | 895 |
| Comparative Example 10 | 500 | 500 | 75 | 33 | 21 | 523 | 1210 | 874 |
| Comparative Example 11 | 500 | 500 | 75 | 33 | 19 | 206 | 452 | 1237 |
| Example 17 | 500 | 500 | 75 | 37 | 30 | 236 | 546 | 1177 |
| Example 18 | 500 | 500 | 75 | 39 | 32 | 282 | 686 | 1057 |
| Example 3 | 500 | 500 | 75 | 43 | 33 | 315 | 724 | 937 |
| Example 19 | 500 | 500 | 75 | 43 | 32 | 421 | 925 | 817 |
| Comparative Example 12 | 500 | 500 | 75 | 32 | 18 | 474 | 1159 | 757 |
| Example 20 | 500 | 500 | 75 | 33 | 28 | 346 | 814 | 854 |
| Example 3 | 500 | 500 | 75 | 43 | 33 | 315 | 724 | 937 |
| Example 21 | 500 | 500 | 75 | 47 | 35 | 284 | 634 | 1020 |
| Example 22 | 500 | 500 | 75 | 48 | 35 | 284 | 634 | 1045 |
| Example 23 | 500 | 500 | 75 | 48 | 34 | 269 | 589 | 1062 |
| Example 24 | 500 | 500 | 75 | 48 | 34 | 269 | 589 | 1089 |
| Example 25 | 500 | 500 | 75 | 46 | 32 | 253 | 544 | 1103 |
| Example 26 | 500 | 500 | 75 | 40 | 29 | 222 | 454 | 1186 |
| Example 27 | 500 | 500 | 75 | 40 | 29 | 222 | 454 | 1206 |
| Comparative Example 13 | — | — | | 28 | 15 | 586 | 1290 | 650 |
| Comparative Example 14 | 500 | — | | 30 | 19 | 505 | 1065 | 730 |
| Comparative Example 15 | 500 | 500 | 75 | 25 | 14 | 298 | 725 | 1090 |
| Comparative Example 16 | 500 | 500 | 75 | 26 | 17 | 210 | 426 | 1150 |
| Comparative Example 17 | 500 | 500 | 75 | 23 | 16 | 460 | 780 | 1100 |
| Example 28 | 500 | 300 | 55 | 39 | 32 | 334 | 761 | 748 |
| Example 29 | 500 | 180 | 90 | 42 | 31 | 279 | 640 | 703 |

From Tables 1 and 2, it is confirmed that in Examples 1 to 29, the DC superimposition characteristics (permeabilities μi and μdc) are high, the core loss is low, and the withstand voltage is high.

On the other hand, in a case where the Vickers hardness (Hv) of any one of the large particles, the medium particles and the small particles is less than 150, the withstand voltage is low (Comparative Examples 1, 3 and 5). In addition, in a case where the Vickers hardness (Hv) of any one of the large particles, the medium particles and the small particles is greater than 600, the DC superimposition characteristics (particularly, permeability μdc) are low (Comparative Examples 2, 4 and 6).

In a case where the average particle size of the large particles is not in the range of 8 μm or more and 15 μm or less for the particle size distribution observed on the cross section, the DC superimposition characteristics (particularly, permeability μdc) are low (Comparative Example 7), or the core loss is high (Comparative Example 8).

In a case where the average particle size of the medium particles is not in the range of 1 μm or more and 5 μm or less for the particle size distribution observed on the cross section, the DC superimposition characteristics (particularly, permeability μdc) are low (Comparative Example 9), or the DC superimposition characteristics (particularly, permeability μdc) are low and the core loss is high (Comparative Example 10).

In a case where the average particle size of the small particles is not in the range of 300 nm or more and 900 nm or less for the particle size distribution observed on the cross section, the DC superimposition characteristics (particularly, permeability μdc) are low (Comparative Example 11), or the DC superimposition characteristics (particularly, permeability μdc) are low and the core loss is high (Comparative Example 12).

In a case where medium particles having an average particle size of 1 μm or more and 5 μm or less and small particles having an average particle size of 300 nm or more and 900 nm or less are not observed for the particle size distribution observed on the cross section, the DC superimposition characteristics are low and the core loss is high (Comparative Example 13).

In a case where small particles having an average particle size of 300 nm or more and 900 nm or less are not observed for the particle size distribution observed on the cross section, the DC superimposition characteristics (particularly, permeability μdc) are low and the core loss is high (Comparative Example 14).

When the total area ratio occupied by the large particles, the medium particles and the small particles is 100% in the cross section, in a case where the area ratio occupied by the large particles is not in the range of 50% to 90% (Comparative Example 17), in a case where the area ratio occupied by the medium particles is not in the range of 0% to 30% (Comparative Example 15) or in a case where the area ratio occupied by the small particles is not in the range of 5% to 30% (Comparative Example 16), the DC superimposition characteristics are low.

DESCRIPTION OF THE REFERENCE NUMERAL

100 an inductor element
110 a core
120 a coil
10 a dust core
11 a large particle
12 a medium particle
13 a small particle
14 an insulating layer
15 spaces

What is claimed is:

1. A dust core comprising large particles having an average particle size of 8 μm or more and 15 μm or less, medium particles having an average particle size of 1 μm or more and 5 μm or less, and small particles having an average particle size of 300 nm or more and 900 nm or less when a cross section thereof is observed, wherein an area ratio occupied by the large particles is 50% to 90%, an area ratio occupied by the medium particles is 0% to 30%, and an area ratio occupied by the small particles is 5% to 30%, when a total area ratio occupied by the large particles, the medium particles and the small particles is 100% in the cross section, wherein Vickers hardness (Hv) of the large particles, the medium particles and the small particles is 150 or more and 600 or less respectively, and wherein the small particles are alloy powder containing Fe and at least Si or Ni.

2. The dust core according to claim 1, wherein the small particles have an electric resistivity of 40 μΩ·cm or more.

3. The dust core according to claim 2, wherein the small particles contain one or more elements selected from the group consisting of Co and Cr.

4. The dust core according to claim 1, wherein the small particles contain one or more elements selected from the group consisting of Co and Cr.

5. An inductor element, comprising the dust core according to claim 1.

6. The dust core according to claim 1, wherein the small particles are alloy powder containing Fe and Si.

7. The dust core according to claim 1, wherein the large particles have an average particle size of 8 μm or more and 13 μm or less, the medium particles have an average particle size of 2 μm or more and 5 μm or less, and the small particles have an average particle size of 300 nm or more and 700 nm or less.

8. The dust core according to claim 1, wherein the large particles have an average particle size of 8 μm or more and 10 μtm or less, the medium particles have an average particle size of 3 μm or more and 5 μm or less, and the small particles have an average particle size of 450 nm or more and 700 nm or less.

9. The dust core according to claim 1, wherein the area ratio occupied by the large particles is 60% to 90%, the area ratio occupied by the medium particles is more than 0% and up to 30%, and the area ratio occupied by the small particles is 5% to 20%.

10. The dust core according to claim 1, wherein the area ratio occupied by the large particles is 65% to 90%, the area ratio occupied by the medium particles is 5% to 30%, and the area ratio occupied by the small particles is 5% to 15%.

11. The dust core according to claim 1, wherein the area ratio occupied by the large particles is 70% to 80%, the area ratio occupied by the medium particles is 5% to 20%, and the area ratio occupied by the small particles is 5% to 10%.

12. The dust core according to claim 1, wherein the Vickers hardness (Hv) of the large particles, the medium particles and the small particles is 300 or more and 600 or less.

13. The dust core according to claim 1, wherein the small particles have an electric resistivity of 55 μΩ·cm or more.

* * * * *